US005850216A

United States Patent [19]

Kwon

[11] Patent Number: 5,850,216

[45] Date of Patent: Dec. 15, 1998

[54] DRIVER CIRCUIT FOR THIN FILM TRANSISTOR-LIQUID CRYSTAL DISPLAY

[75] Inventor: Oh-Kyong Kwon, Seoul, Rep. of Korea

[73] Assignee: LG Semicon Co., Ltd., Cheongju, Rep. of Korea

[21] Appl. No.: 810,921

[22] Filed: Mar. 5, 1997

[30] Foreign Application Priority Data

Jun. 7, 1996 [KR] Rep. of Korea ..... 1996-20218

[51] Int. Cl.[6] ..... G09G 3/36

[52] U.S. Cl. ..... 345/204; 345/98

[58] Field of Search ..... 345/98, 100, 204, 345/205, 206

[56] References Cited

U.S. PATENT DOCUMENTS 4,807,974 2/1989 Hirai ..... 345/98

5,063,378 11/1991 Roach ..... 345/98

*Primary Examiner*—Jeffery Brier

*Assistant Examiner*—Vincent E. Kovalick

*Attorney, Agent, or Firm*—Fleshner & Kim

[57] ABSTRACT

A TFT-LCD driver circuit for sequential and double scanning, includes a scanning pattern generator to generate, in accordance with the scanning direction, category of image to be displayed and a first clock signals, second clock signals and plural scanning pattern signals; a ripple counter to count the second clock signals; a multiplexer to select count signals corresponding to the scanning direction from among those outputted from the ripple counter; a decoder to decode the signals outputted from the multiplexer and to output decoding signals in accordance with the scanning direction; a masking logic to output a masking pulse signal in accordance with the image category under the control of the scanning pattern generator; a NOR gate array NORing the masking pulse signal and the decoding signals outputted from the decoder, and outputting enable signals; and an output cell array including plural output cells logically operating the enable signals the scanning pattern signals and applying them as scanning signals to respective gate lines of the TFT-LCD.

14 Claims, 18 Drawing Sheets

DRIVER CIRCUIT FOR THIN FILM TRANSISTOR-LIQUID CRYSTAL DISPLAY

BACKGROUND OF THE INVENTION

1. Field of the Invention

The present invention relates to a new decoder-type driver circuit for a thin film transistor-liquid crystal display (hereinafter referred to as "TFT-LCD") supporting the sequential and double scanning methods, and particularly, to a driver circuit for a TFT-LCD for the sequential and double scanning methods, which does not use any address signal to drive gate lines and can be controlled more simply, which includes a smaller number of transistors, and which is capable of carrying out bidirectional scanning.

2. Description of the Prior Art

The gate driver circuit included in a TFT-LCD applies sequential scanning signals to gate lines to turn on the thin film transistors (TFT), so that image signals applied from a data driver circuit are controlled so as not to be inscribed in the pixel of the TFT-LCD pannel.

Such conventional gate driver circuit is generally embodied by a shift register consisting of plural D-flip-flops coupled sequentially, or a decoder.

As shown in FIG. 1, master-slave D-flip-flops constituting such a shift register include transmission gates TG1–TG4 and inverters 11–14 to produce an output Q and an inverted output QB by latching the input data in accordance with a pair of clock signals CLK, CLKB. Accordingly, each master-slave D-flip-flop requires 16 transistors.

Moreover, part of the gate driver circuit using a decoder includes, as shown in FIG. 2, a decoder unit 10 decoding address signals A0–A9, AB0–AB9 each formed of 10 bits of high and low signals, respectively, a scanning mode conversion unit 20 for logically operating the output of the decoder unit 10 and pulse signals A, B, C for scanning mode, and converting a sequential scanning mode for VGA signals into a double scanning mode for NTSC signals, or vice versa, a level shifter unit 40 for changing the level of signals output from the scanning mode conversion unit 20, and a buffer unit 50 for buffering the output of the level shifter unit 40 in accordance with output control signals G, GB and applying the buffered output to the gate lines GL1–GL5.

The decoder unit 10 includes plural decoders constituted in the same form as the decoders 10*a*, 10*b* shown. For example, the decoder 10*a* comprises an AND gate 100 for ANDing inverted address signal A9 with a ground potential, AND gate 111 for ANDing inverted address signals A6–A8, a NAND gate 112 for NANDing the output signals of the AND gates 110 and 111, an AND gate 113 for ANDing inverted address signals A3–A5 and an AND gate 114 for ANDing inverted address signals A1–A2 AND AB0, a NAND gate 115 for NANDing the output signals of the AND gates 113, 114, and an AND gate 116 for ANDing the output signals of the NAND gates 112, 115.

The scanning mode conversion unit 20 includes a NAND gate 21 for NANDing the output signal of the decoder 10*a* and scanning mode selection signal A, an OR gate 22 for ORing the output signal of the NAND gate 21 and an inverted high-level voltage VDD, a NAND gate 23 for NANDing the output signal of the NAND gate 23 and the inverted high-level voltage VDD, a NAND gate 25 for NANDing the output signal of the decoder 10*a* and scanning mode selection signal C, a NAND gate 26 for NANDing the output signal of the decoder 10*b* and scanning mode selection signal A, an OR gate 27 for ORing the inverted output signals of the NAND gates 25, 26, a NAND gate 28 for NANDing the output signal of the decoder 10*b* and scanning mode selection signal B, an OR gate 29 for ORing the output signal of the nand NAND gate 28 and the inverted high-level voltage VDD, a NAND gate 30 for NANDing the output signal of the decoder 10*b* and scanning mode selection signal C, and an ORing gate 31 for OR the output signal of the NAND gate 30 and an inverted signal applied thereto from the next stage.

The level shifter unit 40 includes level shifters (inverters) 41 to 45 respectively for changing the levels of signals outputted from the OR gates 22, 24, 27, 29, 31 of the scanning mode switching unit 20.

The buffer unit 50 consists of inverters 51 to 55 for respectively inverting signals outputted from level shifters 41 to 45 of the level shifter 40, and buffers 56 to 60 for respectively buffering inverted signals from the inverters 51 to 55 and applying them to the gate lines, in accordance with the inverted output control signal GB and the output control signal G.

The operation of a gate driver circuit using the thusly composed conventional decoder is described as below with reference to the accompanying drawings.

Since the gate driver circuit using a conventional decoder has a 10 bit signal input out of address signals A0 to A9, AB0 to AB9, it can drive 1024 gate lines at most, and requires 20 signal lines.

Moreover, the plural decoder units included in the decoder 10 have different 10 bit address signals input, and output "1" only when all the input 10 bit address signals are "1". Accordingly, such plural decoders output "1" sequentially according to the combination of the address signals A0 to A9 and invented signals AB0 to AB9.

Subsequently, the scanning mode switching unit 20 logically operates the output signals of the decoder 10 and the scanning mode selection signals A, B, C, and such logically operated signals are applied to gate lines GL1 to GL5 through the level shifter unit 40 and the buffer unit 50 to drive gate lines GL1 to GL5.

For utilization of such a gate driver circuit in a TV or computer, it has to process both VGA and NTSC signals.

In the case of VGA signals, a sequential scanning mode is employed as shown in FIG. 3, in which after applying a scanning start signal VST to the gate driver circuit, high-level scanning signals corresponding to one cycle of the system clock signal VCK are applied sequentially to gate lines GL1 to GL3.

In the case of NTSC signals using a double scanning mode, after the scanning start signal VST is applied to the gate driver circuit in an even field, as shown in FIG. 4, the scanning signals corresponding to one cycle of the system clock signal VCK are applied simultaneously to gate lines GL1, GL2, and then the scanning signals corresponding to one cycle of the system clock signal VCK are applied simultaneously to gate lines GL3, LG4, and in this way, the scanning signals are applied up to the 479th and 480th gate lines. While, in the odd field, the scanning signals corresponding to one cycle of the system clock signal VCK are first applied to the gate line GL1, and then the scanning signals are applied simultaneously to gate lines GL2, GL3, and in this way, the scanning signals are applied up to 480th gate line.

However, the above-mentioned conventional gate driver circuit includes either 16 transistors for each flip-flop, in the case where it employs the master-slave flip-flops, or 40 transistors by stage corresponding to each decoder, in the case where it employs the decoder scheme, and it becomes thereby bulky and disadvantageously complex. This number of transistors does not include that of transistors used for control unit installed outside the LCD panel to control each stage.

Furthermore, the conventional decoder scheme gate driver circuit requires 18 control input signals to drive 480 gate lines, and 18 signal lines are distributed over a range or several centimeters over the full length of the gate driver circuit. It consequently has disadvantages in not only the area occupied by such wiring in chips, and but also the dangers of cutting and short-circuiting between such long signal lines, are increased so much that the yield is reduced and a delay of signals occurs.

The conventional decoder scheme gate driver circuit has the further disadvantages that address signals inputted in the decoder must be adjusted so as to produce bidirectional scanning pulses and such address signals, being supplied from a control unit outside the LCD panel, require a number of pads in the LCD panel.

SUMMARY OF THE INVENTION

An object of the present invention is, therefore, to provide a TFT-LCD driver circuit suitable for sequential and double scanning schemes, which is more simply controllable because of using no address signal to drive gate lines, which includes fewer transistors, and which can perform bidirectional scanning.

To achieve the above object, the TFT-LCD driver circuit according to present invention includes a scanning pattern generator to generate, in accordance with the scanning direction, category of image to be displayed and a first clock signals, second clock signals and plural scanning pattern signals; a ripple counter to count the second clock signals; a multiplexer to select count signals corresponding to the scanning direction from among those outputted from the ripple counter; a decoder to decode the signals outputted from the multiplexer and to output decoding signals in accordance with the scanning direction; a masking logic to output a masking pulse signal in accordance with the image category under the control of the scanning pattern generator; a NOR gate array for NORing the masking pulse signal and the decoding signals outputted from the decoder, and outputting enable signals; and an output cell array including plural output cells logically operating the enable signals the scanning pattern signals and applying them as scanning signals to respective gate lines of the TFT-LCD.

BRIEF DESCRIPTION OF THE DRAWINGS

The present invention will become more fully understood from the detailed description given below and the accompanying drawings which are given by way of illustration only and thus are not limitative of the present invention, and wherein;

FIGS. 3(A) to 3(E) are waveform diagrams of system clock and scanning start signals and scanning signals applied to gate lines in the circuit of FIG. 2, in the case of VGA signals, wherein, FIGS. 3(A) and 3(B) are waveform diagrams of system clock and scanning start signals, respectively, and FIGS. 3(C) to 3(E) are waveform diagrams of scanning signals;

FIGS. 4(A) to 4(F) are waveform diagrams of system clock and scanning start signals and scanning signals applied to gate lines in the circuit of 2, in the case of NTSC signals, wherein, FIGS. 4(A) and 4(B) are waveform diagrams of system clock and scanning start signals, respectively, and FIGS. 4(*c*) to (F) are waveform diagrams of scanning signals;

FIGS. 7(A) to 7(I) are respectively a detailed circuit diagram of an input controller in the circuit of FIG. 6 and waveform diagrams of input/output signals thereof, wherein, FIG. 7(A) is a detailed circuit diagram of the input controller in the circuit of FIG. 6, FIG. 7(B) is a waveform diagram of a scanning start signal applied from a control unit in the circuit of FIG. 5, FIG. 7(C) is a waveform diagram of a final scanning signal applied from a multiplexer in the circuit of FIG. 6, FIG. 7(D) is a waveform diagram of an output signal of an OR gate in the circuit of FIG. 7(A), FIG. 7(E) is a waveform diagram of an output signal of a T-flip-flop in the circuit of FIG. 7(A).

FIG. 7(F) is a waveform diagram of a system clock signal applied from the control unit, in the circuit of FIG. 5, FIG. 7(G) is a waveform diagram of a first clock signal outputted from an AND gate in the circuit of FIG. 7(A), FIG. 7(H) is a waveform diagram of a reset signal applied from the control unit in the circuit of FIG. 5, and FIG. 7(I) is a waveform diagram of a reset signal outputted from an exclusive OR gate in the circuit of FIG. 7(A);

FIGS. 9(A) to (E) are waveform diagrams of input and output signals of the scanning pattern generator in the circuit of FIG. 6, wherein, FIG. 9(A) shows waveform diagrams of the system and first and second clock signals inputted in the ripple counter in the circuit of FIG. 6, in the case of NTSC signals, FIG. 9(B) shows waveform diagrams of the first clock signals inputted and the second clock signals inputted in the ripple counter in the circuit of FIG. 6, in the case of VGA signals, FIG. 9(C) is a waveform diagram of the first clock signals inputted and the scanning pattern signals outputted to the output cells array in the circuit of FIG. 6, in the case of NTSC signals, FIG. 9(C) is a waveform diagram of the first clock signals inputted and the scanning pattern signals outputted to the output cells array in the circuit of FIG. 6, in the case of NTSC signals, FIG. 9(D) is a waveform diagram of the first clock signals inputted and the scanning pattern signals outputted to the output cells array in the circuit of FIG. 6, in the case of VGA signals, FIG. 9(E) is a waveform diagram of the first clock signals inputted and the masking signals outputted to the masking logic in the circuit of FIG. 6;

FIGS. 13(A) and 13(B) are detailed schematic circuit diagrams of NOR gate arrays in the circuit of FIG. 6, wherein, FIG. 13(A) is a detailed schematic circuit diagram of the NOR gate array corresponding to a scanning from top to bottom, and FIG. 13(B) is a detailed circuit diagram of the NOR gate array corresponding to a scanning from bottom to top;

FIGS. 14(A) to 14(H) are waveform diagrams of system clock signals, second clock signals, and signals outputted from the decoder in the circuit of FIG. 6, in the case of NTSC signals, wherein, FIG. 14(A) is a waveform diagram of the system clock signal outputted from the control unit in the circuit of FIG. 5, FIGS. 14(B) and 14(C) are waveform diagrams of the second clock signals applied from the decoder in the circuit of FIG. 6, FIGS. 14(D) to 14(H) and waveform diagrams of decoding signals outputted from the decoder in the circuit of FIG. 6;

FIGS. 15(A) to 15(I) are waveform diagrams of system clock signals, second clock signals, input and output signals of the masking logic in the circuit of FIG. 6, and of signals outputted from the decoder, in the case of VGA signals, wherein, FIG. 15(A) is a waveform diagram of the system clock signal outputted from the control unit in the circuit of FIG. 6, FIGS. 15(B) and 15(C) are waveform diagrams of the second clock signals inputted in the ripple counter in the circuit of FIG. 6, FIGS. 15(D) to 15(E) are waveform diagrams of the masking signals inputted in the masking logic in the circuit of FIG. 6, FIG. 15(F) is a waveform diagram of the pulse masking signal outputted from the masking logic in the circuit of FIG. 6, and FIGS. 15(G) to 15(I) are waveform diagrams of the decoding signals outputted from the decoder in the circuit of FIG. 6;

FIGS. 17(A) to 17(I) are waveform diagrams of input and output signals of output cells in the circuit of FIG. 16, in the case where the scanning signals for NTSC signals are generated from top to bottom, wherein, FIG. 17(A) is a waveform diagram of a random enable signal applied from a NOR gate array in the circuit of FIG. 16, FIGS. 17(B) to 17(E) are waveform diagrams of the scanning pattern signals applied from a scanning pattern generator in the circuit of FIG. 6, and FIGS. 17(F) to 17(I) are waveform diagrams of the scanning signals applied to gate lines;

FIGS. 18(A) to 18(I) are waveform diagrams of input and output signals of the output cells in the circuit of FIG. 16, in the case where the scanning signals for VGA signals are generated from top to bottom, wherein, FIG. 18(A) is a waveform diagram of a random enable signal applied from the NOR gate array in the circuit of FIG. 6, FIGS. 18(B) to 18(E) are waveform diagrams of the scanning pattern signals applied from the scanning pattern generator in the circuit of FIG. 6, and FIGS. 18(F) to 18(I) are waveform diagrams of the scanning signals applied to gate lines;

FIGS. 19(A) to 19(I) are waveform diagrams of input and output signals of output cells in the circuit of FIG. 16, in case where the scanning signals for the NTSC signals are generated from below to above, where in, FIG. 19(A) is a waveform diagram of a random enable signal applied from a NOR gate array in the circuit of FIG. 6, FIGS. 19(B) to 19(E) are waveform diagrams of scanning pattern signals applied from a scanning pattern generator in the circuit of FIG. 6, and FIGS. 19(F) to 19(I) are waveform diagrams of scanning signals applied to gate lines.

DETAILED DESCRIPTION OF THE INVENTION

Figure 5:
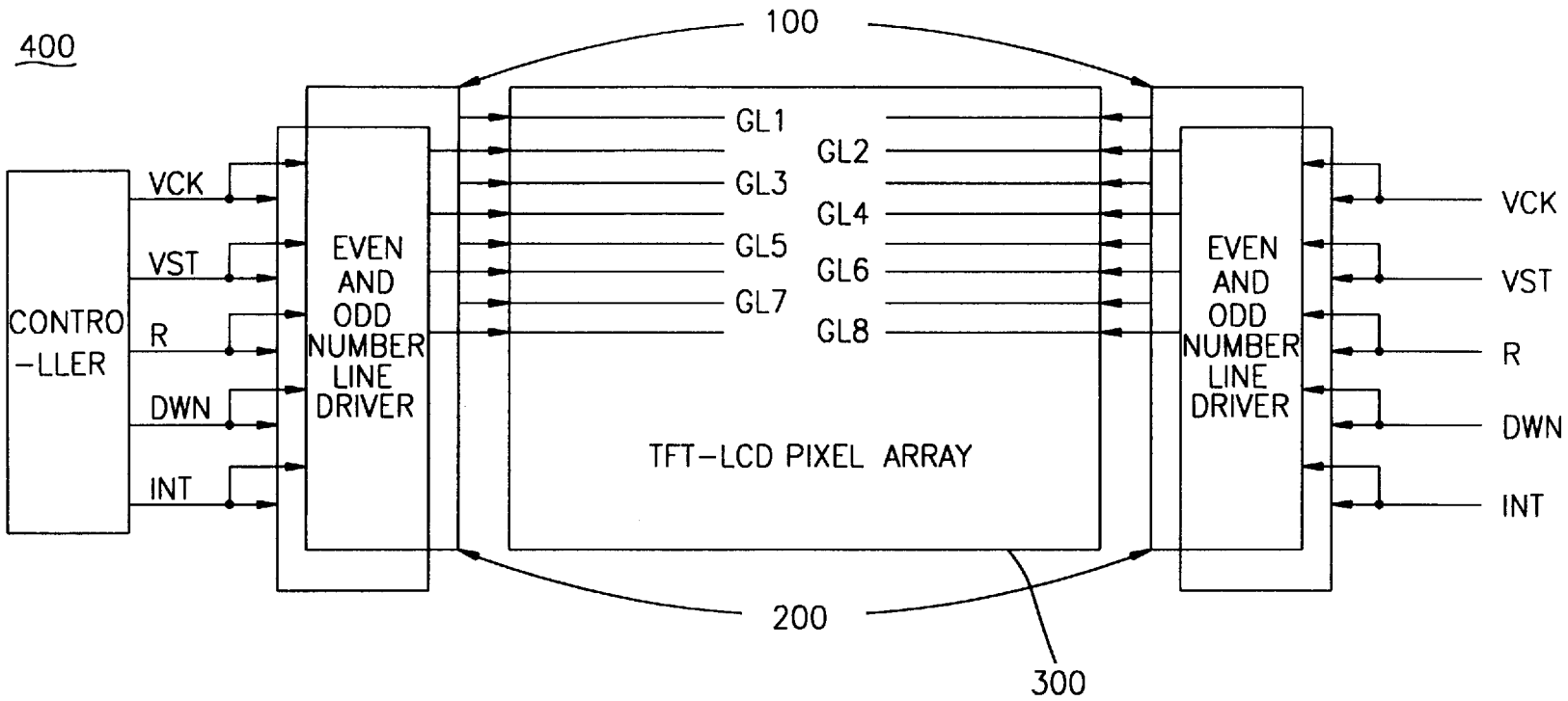
FIG. 5 is a schematic block diagram of a TFT-LCD driver circuit according to the present inveilion.

As shown in FIG. 5, the TFT-LCD driver circuit according to the present invention includes an even line drive unit 100 to drive the even numbered gate lines, and an odd line drive unit 200 to drive the odd numbered gate lines, under the control of a control unit 400, and each gate line is coupled with a TFT-LCD pixel array 300.

The even and odd line drive units 100, 200 are identically constructed, and each does not drive 480 gate lines in total, but 240 gate lines, respectively. Therefore, only the odd line drive unit 100 will be described hereinafter.

Figure 6:
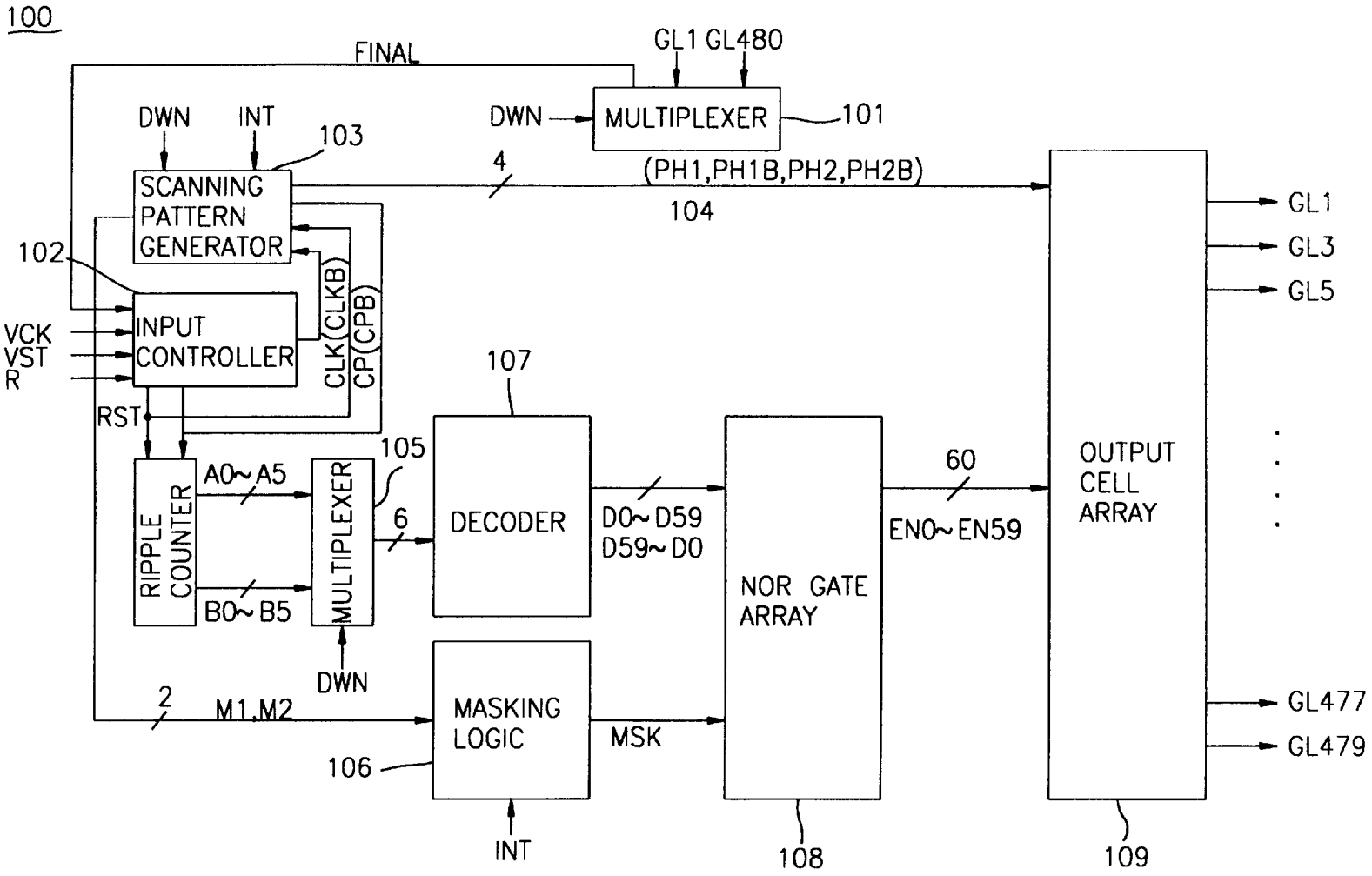
FIG. 6 is a detailed schematic block diagram of an odd line drive unit in the circuit of FIG. 5.

As shown in FIG. 6, the odd line drive unit 100 includes a multiplexer 101 for selecting signals to be applied to the first or 480th gate line GL 1 or GL 480 according to the scanning direction control signal DWN applied from the control unit 400, and outputting the final scanning signal FINAL; an input controller 102 generating reset signals RST and clock signals CLKB according to the final scanning signal FINAL outputted from the multiplexer 101 and the scanning start signal VST, system clock signal VCK and system reset signal R, applied from the control unit 400; a scanning pattern generator 103 generating masking signals Ml, M2, scanning pattern signals PH1, PH1B, PH2, PH2B, and clock signals CP, CPB, according to reset signal RST and clock signals CLK, CLKB outputted from the input controller 102, scanning direction control signal DWN applied from the control unit 400, and image mode signal INT for selecting NTSC and VGA signals; a ripple counter 104 counting clock signals CP, CPB outputted from the scanning pattern generator 103 according to the reset signal RST outputted from the input controller 102 and outputting count signals A0–A5, B0–B5; a multiplexer 105 selecting and outputting count signals A0–A5 or B0–B5 outputted from the ripple counter 104 according to the scanning direction control signal DWN/ a masking logic 106 receiving input of masking signals M1, M2 outputted from the scanning pattern generator 103 and outputting pulse masking signal MSK according to the image mode signal INT; a decoder 107 decoding output signals from the multiplexer 105 and outputting decoding signals D0–D59, D59–0; a NOR gate array 108 for NORing decoding signals D0–59, D59–0 outputted from the decoder 107 and outputting enable signals FN0–EN59 outputted from the NOR gate array 108 and the scanning pattern signals PH1, PH1B, PH2, PH2B outputted from the scanning pattern generator 103, and applying scanning signals to respective gate lines GL1–GL480.

Figure 7A:
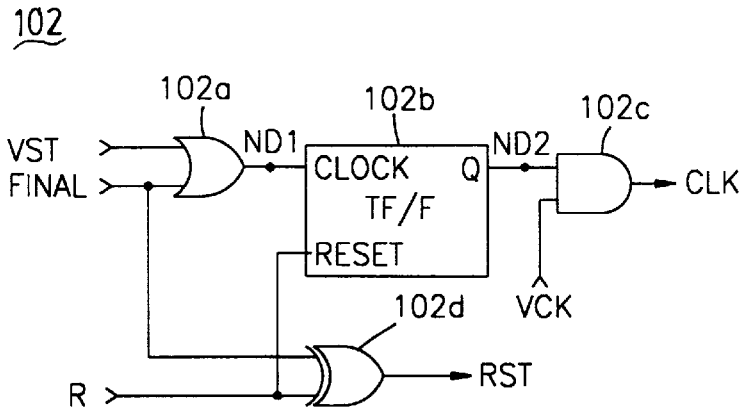

As shown in FIG. 7(A), the input controller 102 includes an OR gate 102*a* ORing the scanning start signal VST and the final scanning signal FINAL outputted from the multiplexer 101; a T-flip-flop 102*b* receiving at its clock input the output signals of the OR gate 102*a* and at its reset input system reset signal R; and AND gate 102*c* ANDing the Q output signal of the T-flip-flop 102*b* and the system clock signal VCK, and outputting clock signal CLK; and an exclusive OR gate 102*d* making exclusive ORing the final scanning signal FINAL and the system reset signal R and outputting reset signal RST. The clock signal CLKB is the inversion signal of the clock signal CLK.

Figure 8:
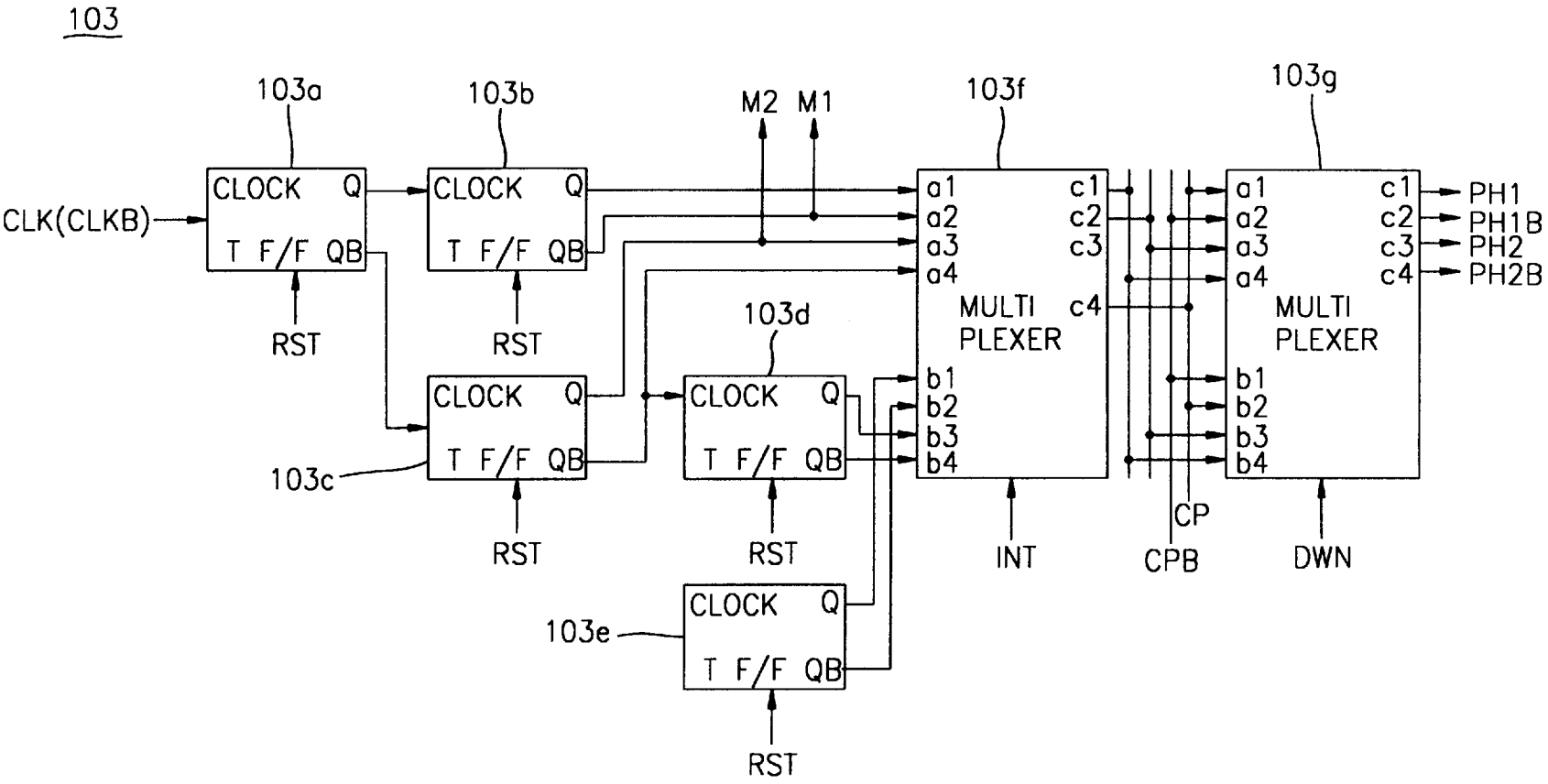
FIG. 8 is a detailed schematic circuit diagram of the scanning pattern generator in the circuit of FIG. 6.

As shown in FIG. 8, the scanning pattern generator 103 includes a T-flip-flop 103*a* receiving at its clock input the clock signals CLK, CLKB and at its reset input the signal RST outputted from the input controller 102; a T-flip-flop 103*b* receiving at its clock input signal from and at its reset input the reset signal RST and outputting masking signal M1 through its output terminal OB; a T-flip-flop 103*c* receiving at its reset input the reset signal RST and at its clock input the signals from the QB output terminal of the T-flip-flop 103*a*, and outputting masking signal M2 through its output terminal Q; a T-flip-flop 103*d* receiving at its reset input the reset signal RST and at its clock input the signal from the output terminal QB of the T-flip-flop 103*c*; a T-flip-flop 103*e* receiving at its reset input the reset signal RST and at its clock input the signal from the output terminal Q of the T-flip-flop 103*c*; a multiplexer 103*f* selecting signals outputted from the T-flip-flops 103*b*, 103*e*, 103*d* through its input terminals b1–b4, according to the image mode signal INT, and outputting clock signals CP, CPB through its output terminals c4, c3; a multiplexer 103*g* receiving signals respectively outputted from output terminals c1–c4 of the multiplexer 103*f* through its input terminals a4–a1, b4, b3, b1, b2, selecting such input signals according to the scanning direction control signal DWN, and then outputting scanning pattern signals PH1, PH1B, PH2, PH2B through its output terminals c1–c4.

Figure 10:
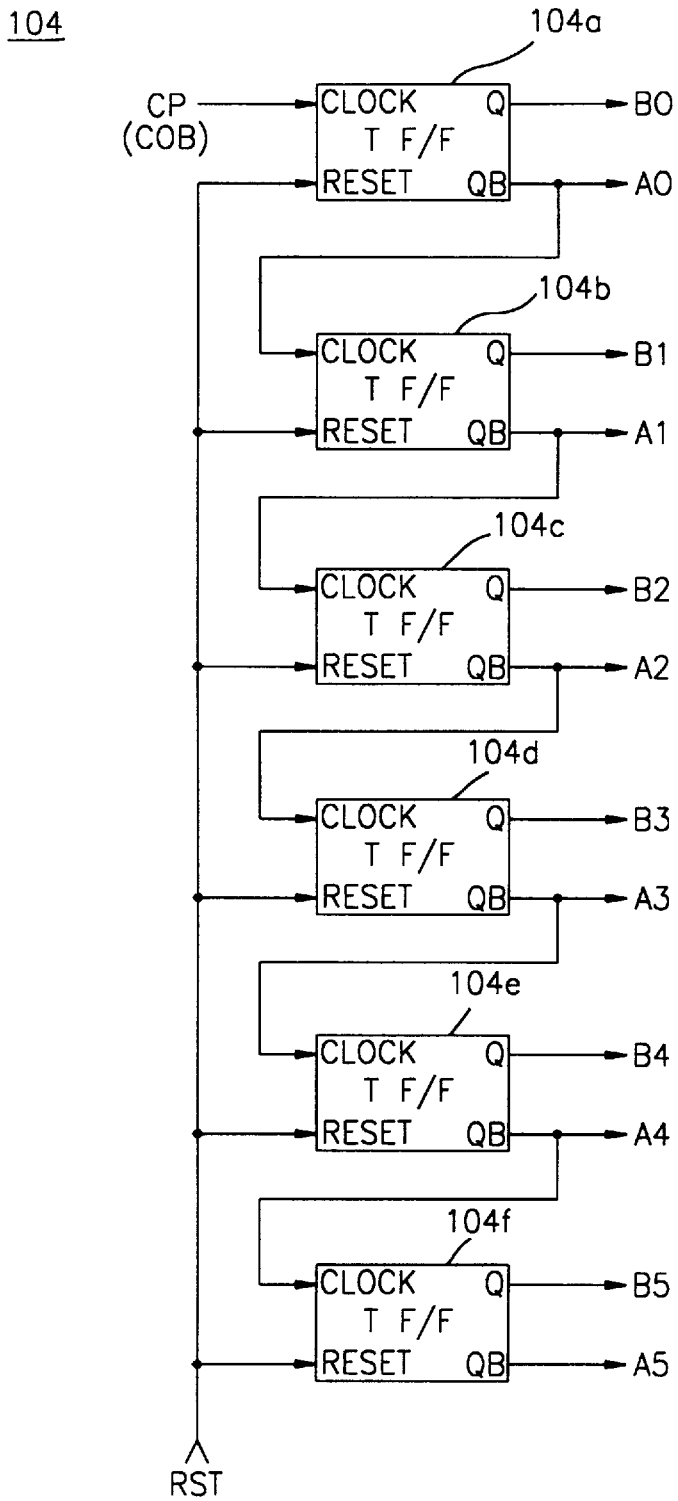
FIG. 10 is a detailed schematic circuit diagram of the ripple counter in the circuit of FIG. 6.

As shown in FIG. 10, the ripple counter 104 includes a T-flip-flop 104*a* receiving at its clock input the clock signals CP, CPB and at its reset input the reset signal RST outputted from the scanning pattern generator 103, and outputting count signals A0, B0 through its output terminals QB, Q, respectively; a T-flip-flop 104*b* receiving at its clock input the RST, and outputting count signals A1, B1 through its output terminals QB, Q, respectively; a T-flip-flop 104*c* receiving at its clock input the count signal as outputted from the T-flip-flop 104*b*, and at its reset input the reset signal RST and outputting count signals A2, B2 through its output terminals QB, Q, respectively; a T-flip-flop 104*d* receiving at its clock input the count signal A2 outputted from the T-flip-flop 104*c* and at its reset input the reset signal and outputting count signals A3, B3 through its output terminals QB, Q, respectively; a T-flip-flop 104*e* receiving at its clock input the count signal A3 outputted from the T-flip-flop 104*d* and at its reset input the reset signal RST and outputting count signals A4, B4 through its output terminal QB, Q, respectively; a T-flip-flop 104*f* receiving at its clock input the count signal A4 outputted from the T-flip-flop and at its reset input the reset signal RST and outputting count signals A5, B5 through its output terminals QB, Q, respectively.

Figure 11:
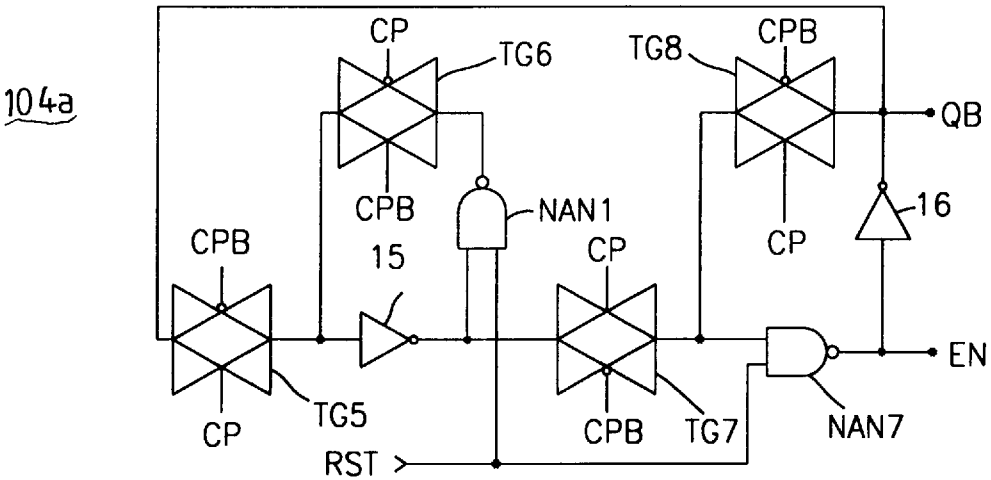
FIG. 11 is a detailed schematic circuit diagram of a T-flip-flop in the circuit of FIG. 10.

As shown in FIG. 11, the T-flip-flop 104*a* includes NAND gates NAN1, NAN2 each receiving at one input thereof the reset signal RST; transmission gates TG 5–TG8 each receiving at their control inputs the clock signals CP, CPB; and inverters 15, 16. The constitution of the other T-flip-flops 104*b*14 104*f* is identical with that of the T-flip-flop 104*a*.

Figure 12:
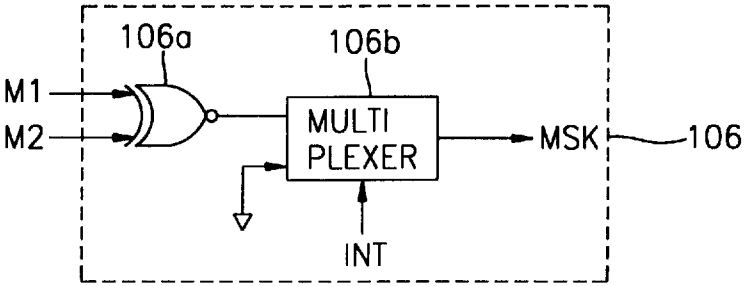
FIG. 12 is a detailed schematic circuit diagram of the masking logic in the circuit of FIG. 6.

As shown in FIG. 12, the masking logic 106 includes an exclusive NOR gate 106*a* for exclusive NORing masking signals M1, M2 applied from the scanning pattern generator 103, and a multiplexer 106*b* selecting either the output signal of the exclusive NOR gate 106*a* or a low-level ground voltage according to the image mode signal INT and outputting pulse masking signal MSK.

Figure 13A:
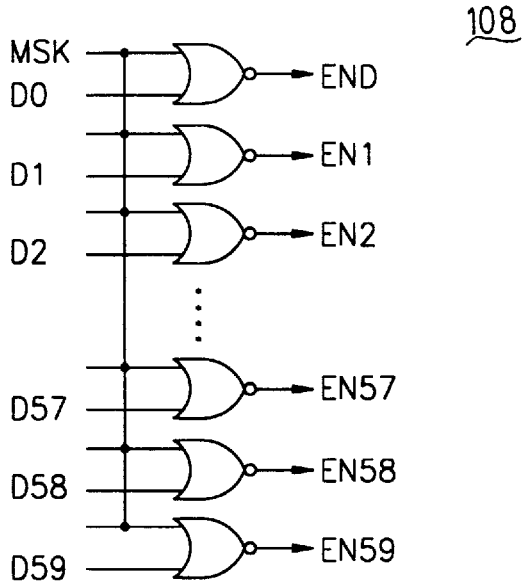
Figure 13B:
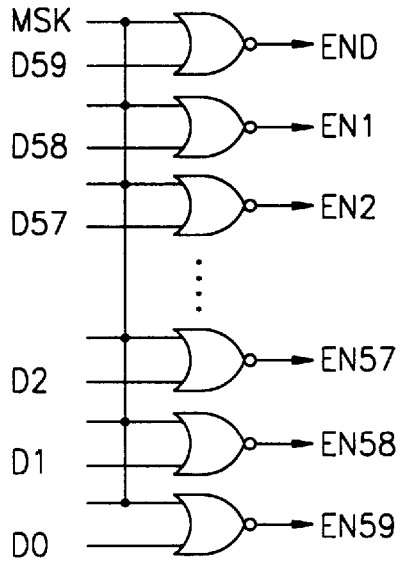

As shown in FIG. 13(A), the NOR gate array 108 includes plural NOR gates respectively NORing the pulse masking signal MSK applied from the masking logic 106 and decoding signals D0–D59 applied from the decoder 107, in the case where the gate lines are scanned from above(top) to below(bottom), that is, the scanning is carried out sequentially from the gate line GL1 to the gate line GL 479, and then respectively outputting enable signals EN0–EN59. In the case where gate lines are scanned from below(bottom) to above(top), that is, the scanning is carried out from the gate line GL 479 to the gate line GL1, the NOR gate array 108 receives the input of decoding signals D59–D0 in place of the decoding signals D0–D59, as shown in FIG. 13(B).

Figure 16:
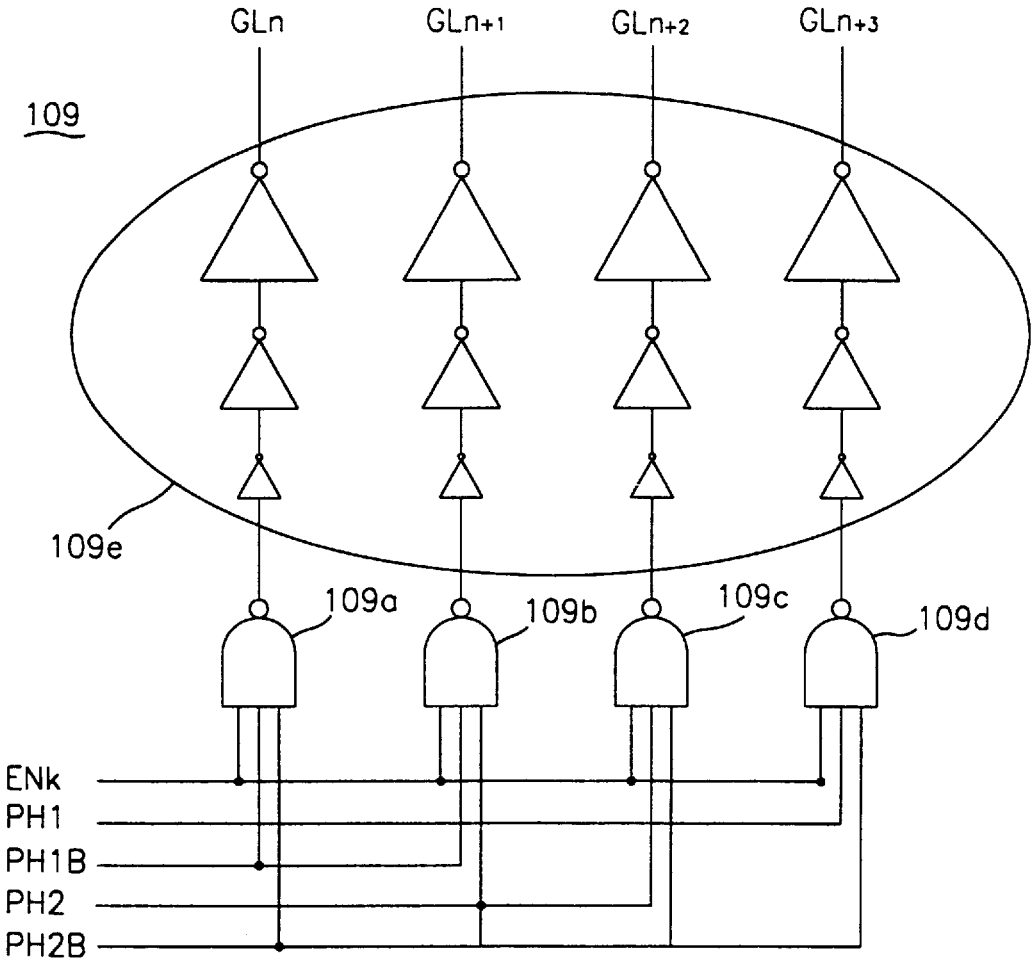
FIG. 16 is a detailed schematic circuit diagram of a random output cell included in the output cell array in the circuit of FIG. 6.

As shown in FIG. 16, the output cell array 109 includes plural cells each respectively corresponding to one of the enable signals EN0–EN59 applied from the NOR gate array 108, and each driving 4 gate lines, respectively. For example, since the odd line drive unit 100 of the present invention drives the odd 240 of the gate lines GL 1–GL 479, the output cell array 109 includes 60 output cells.

As shown in FIG. 16, each output cell of the plural output cells which correspond to one of the random enable signals ENK, (k=0 . . . 59) includes a NAND gate 109*a* NANDing the enable signal ENk outputted from the NOR gate array 108 and scanning pattern signals PH1B, PH2B applied from the scanning pattern generator 103; a NAND gate 109*b* NANDing the enable signal ENk and the scanning pattern signals PH1B, PH2 applied from the scanning pattern generator 103; a NAND gate 109*c* NANDing the enable signal ENk and the scanning pattern signals PH1, PH2; a NAND gate 109*d* NANDing the enable signal ENk and the scanning pattern generator 103; and a buffer 109*e* buffering the output signals of the NAND gates 109*a*–109*d* including inverters connected sequentially to the outputs thereof, and applying such buffered signals to gate lines GLn–GLn+3 as scanning signals. The constitution of the other output cells corresponding to the enable signal ENK is identical with that of the above-described output cell.

The operation and effect of the present invention having the above-described construction will now be hereinafter described in detail.

In order to enable the control unit 400 disposed outside the TFT-LCD pixel array 300 to carry out a bidirectional scanning without operating separate conventional address signals, the present invention employs scanning direction control signal DWN. In other word, in the case where the scanning direction control signal DWN is "1", the gate lines are driven sequentially from GL1 to GL480, and in the case where direction control signal DWN is case "0", they are driven in the opposite sequence.

Accordingly, in the case where the scanning direction control signal DWN is "1", the last driven gate line is the 480th gate line, so that the multiplexer 101 applies the applied scanning signal to 480th gate line GL480 to the input controller 102 as the final scanning signal FINAL. In the case where the scanning signal DWN is "0", the pulse signal applied to the first gate line GL1 is applied to the input controller 102 as the final scanning signal FINAL.

Figure 7B:
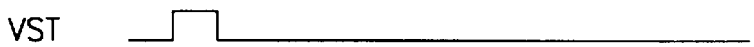
Figure 7C:
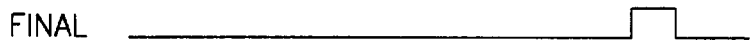
Figure 7D:
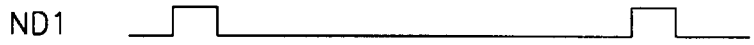
Figure 7E:
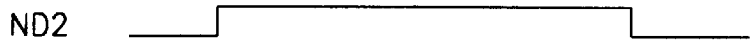
Figure 7F:
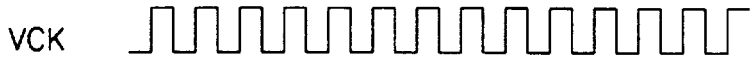
Figure 7G:
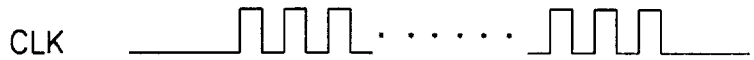
Figure 7H:
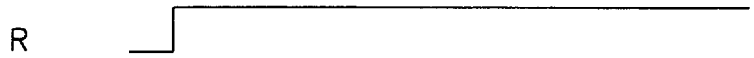
Figure 7I:
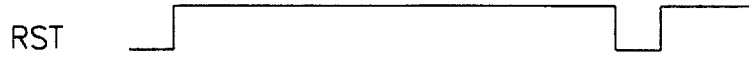

With reference to FIG. 7, the OR gate 102*a* of the input controller 102 outputs the signals as shown in FIG. 7(*c*), by ORing the scanning start signal VST as shown in FIG. 7(B) and the final scanning signal FINAL as shown in FIG. 7(C), applied from the multiplexer 101. The T-flip-flop 102*b* latches signal ND1 outputted from the OR gate 102*a*, and outputs signal ND2 as shown in FIG. 7(E). Subsequently, the AND gate 102*c* ANDS signal ND2 outputted from the T-flip-flop 102*b* and system clock signal VCK, and the outputs clock signal CLK as shown in FIG. 7(G), to the scanning pattern generator 103. Therefore, the cycles of the system clock signal VCK and the clock signal CLK become identical.

Although the system clock signal VCK continues to be supplied from the control unit 400 outside the TFT-LCD pixel array 300, the clock signal CLK outputted from the AND gate 102*c* is generated only during the effective scanning period, that is, only during the period between the scanning start signal VST and the final scanning signal FINAL. Accordingly, the clock signal CLK is not generated only during a blanking period.

Moreover, since the system reset signal R is supplied only once at the beginning of the system operation, the exclusive OR gate 102*d* is used so as to supply the reset signal RST to the scanning pattern generator 103 and the ripple counter 104 for each field and frame of the image signals.

The exclusive OR gate 102*d* exclusive ORs the final scanning signal FINAL and the system reset signal R, and then applies the resultant reset signal RST to the scanning pattern generator 103 and the ripple counter 104. In the case where the reset signal RST is at low level, the scanning pattern generator 103 and the ripple counter 104 are reset.

With reference to FIGS. 8 and 9, the T-flip-flop 103*a* of the scanning pattern generator 103 outputs the input clock signal CLK whilst reducing the frequency thereof by half; the T-flip-flop 103*b* outputs the signal inputted from the output terminals Q and QB, respectively of the T-flip-flop 103 to the respective input terminals a1, a2 of the multiplexer 103*f*, whilst reducing the frequency thereof by half; and the T-flip-flop 103*c* outputs from its Q and QB output terminals, respectively the signal inputted from the output terminal QB of the T-flip-flop 103*a* to the respective input terminals a2, a3 of the multiplexer 103*f*, whilst reducing the frequency thereof by half.

Figure 9A:
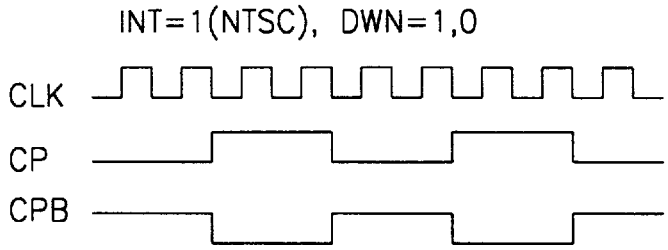
Figure 9B:
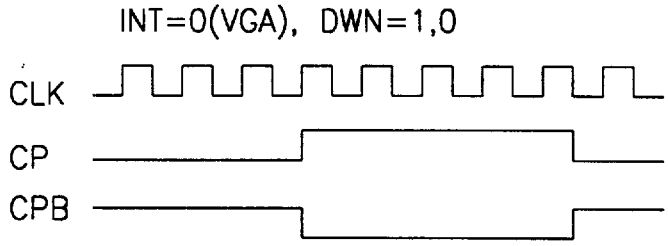
Figure 9C:
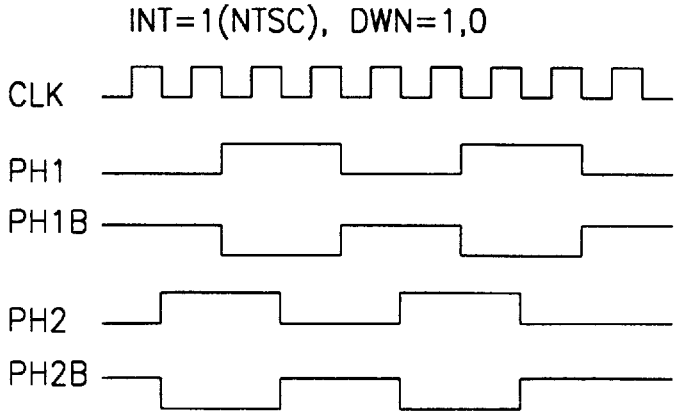
Figure 9D:
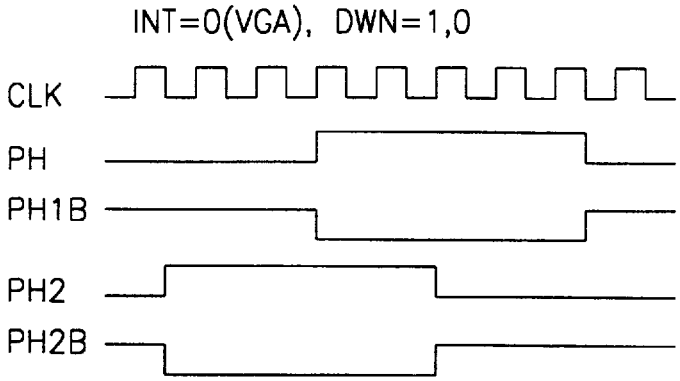
Figure 9E:
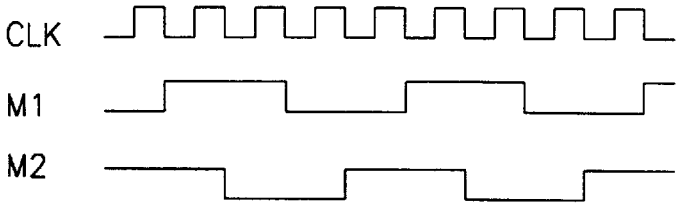

As shown in FIG. 9(E), high-level masking signals M1, M2 are supplied to the masking logic 106 during 2 cycles of clock signal CLK.

The T-flip-flop 103*d* outputs from its Q and QB output terminals the signal inputted from the output terminal OB of the T-flip-flop 103*c*, to the respective input terminals b3, b4 of the multiplexer 103*f*, whilst reducing the frequency thereof by half, and the T-flip-flop 103*e* outputs through its Q and QB output terminals the signal inputted from the output terminal Q of the T-flip-flop 103*c*, to the respective input terminals b1, b2 of the multiplexer 103*f*, whilst reducing the frequency thereof by half.

In the case of an NTSC signal, that is, in the case where the image mode signal INT is "1", the multiplexer 103*f* selects the output signals of the T-flip-flops 103*b*, 103*c*, applied to its input terminals a1–a4 of the multiplexer 103*f*, and outputs them to the multiplexer 103*g* through its output terminals c1–c4. The signals outputted through output terminals c4–c3 are supplied to the ripple counter 104 as clock signals CP, CPB.

Sine the clock signal CP is the signal outputted from the output terminal QB of the T-flip-flop 103*c*, and the clock signal CPB is the signal outputted from the output terminal Q of the T-flip-flop 103*c*, the clock signals CP, CPB have a high-level during 2 cycles of clock signal CLK, as shown in FIG. 9(A).

In the case of a VGA signal, that is, in the case where the image mode signal INT is "0", the multiplexer 103*f* selects the output signals of the T-flip-flops 103*e*, 103*d*, applied to its input terminals b1–b4, and then outputs them through its output terminals c1–c4. The signals outputted through the output terminals c4–c3 are supplied to the ripple counter 104 as clock signals CP, CPB.

Since the clock signal CP is the signal outputted from the inversion output terminal QB of the T-flip-flop 103*d*, and the clock signal CPB is the signal outputted from the output terminal Q of the T-flip-flop 103*d*, the clock signals CP, CPB have a high-level during 4 cycles of clock signal CLK, as shown in FIG. 9(B).

As described above, in the case of a VGA signal, the clock signals applied to the ripple counter 104 pass through the T-flip-flops 103*d*, 103*e*, so that their frequency is reduced by half compared to the case of an NTSC signal.

In case where the scanning direction control signal DWN is "1", that is, in the case where gate lines GL1–GL479 are scanned from above to below, the multiplexer 103*g* receives the signals outputted from the output terminals c1–c4 of the multiplexer 103*f*, through its input terminals a4–a1, and after selecting such input signals as scanning pattern signals PH1, PH2, PH2B, outputs them through its output terminals c1–c4.

In the case of an NTSC signal, the scanning pattern signals PH1, PH1B, PH2, PH2B, 1 cycle of which corresponds to 4 cycles of system clock signal VCK, are supplied to the output cell array 109, as shown in FIG. 9(C), and in the case of a VGA signal, the scanning pattern signals PH1, PH1B, PH2, PH2B 1 cycle of which corresponds to 8 cycles of system clock signal VCK, are supplied to the output cell array 109, as shown in FIG. 9(D).

The T-flip-flops 104*a*–104*f* of the ripple counter 104 shown in FIG. 10 count the reset signal RST applied from the input controller 102 and the clock signals CP, CPB applied from the scanning pattern generator 103, and then apply the count signals A0–A5, B0–B5 to the multiplexer 105. When the reset signal RST is applied to the ripple counter 104, the count signals A0–A5 are reset at a value of "000000", and the count signals B0–B5 at a value of "111111", respectively. Subsequently, as the clock signals CP, CPB are applied to the T-flip-flop 104*a*, the count signals A0–A5 have the values "000001", "000010", "000011", . . . , "111111", and the count signals B0–B5 the vales "111110", "111101", "111100", . . . , "000000", respectively.

Figures 14A, 14B, 14C, 14D, 14E, 14F, 14G, 14H:
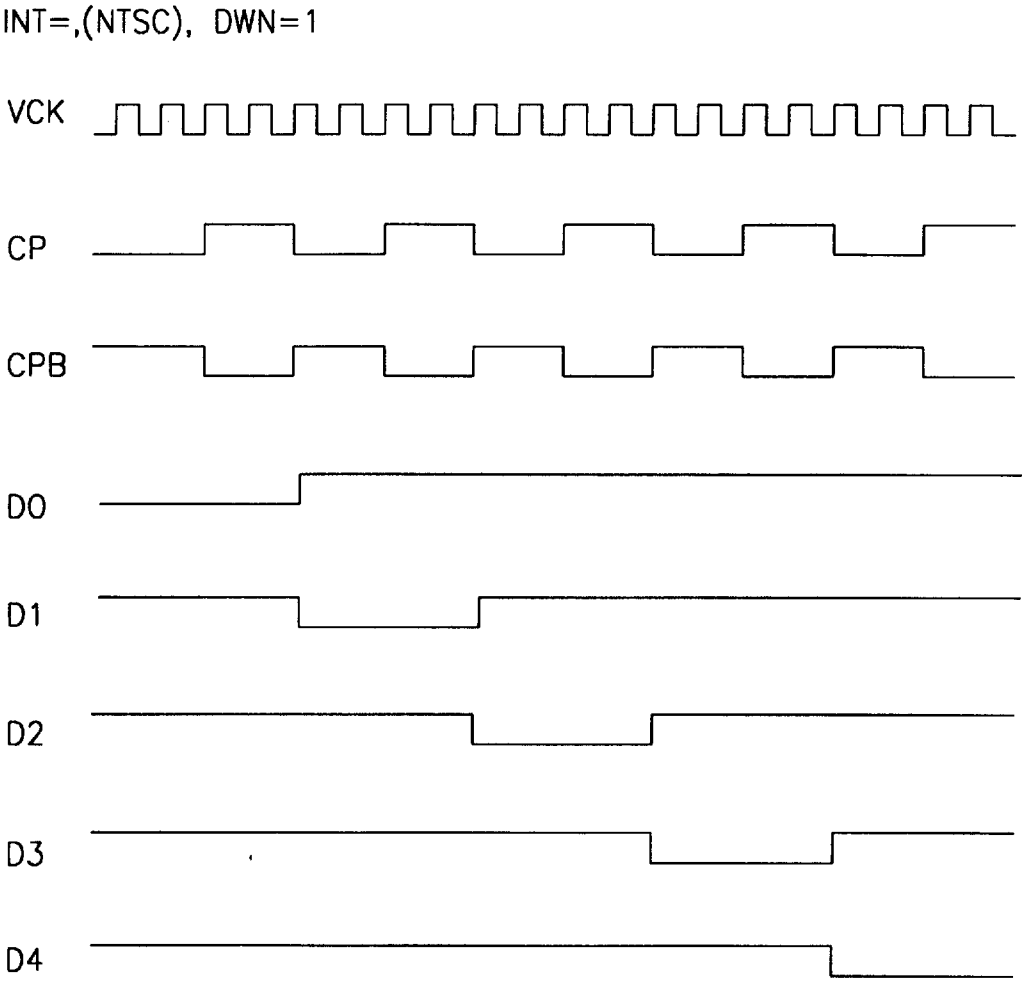

In the case of the NTSC signal, the high-level clock signals CP, CPB are applied to the T-flip-flop 104*a* of the ripple counter 104 during 2 cycles of the system clock signal VCK, as shown in FIGS. 14(B) 14(C), and the sequentially connected T-flip-flops 104*a*–104*f* operate as frequency multiplier circuits, respectively, as shown in FIG. 8.

Figures 15A, 15B, 15C, 15D, 15E, 15F, 15G, 15H, 15I:
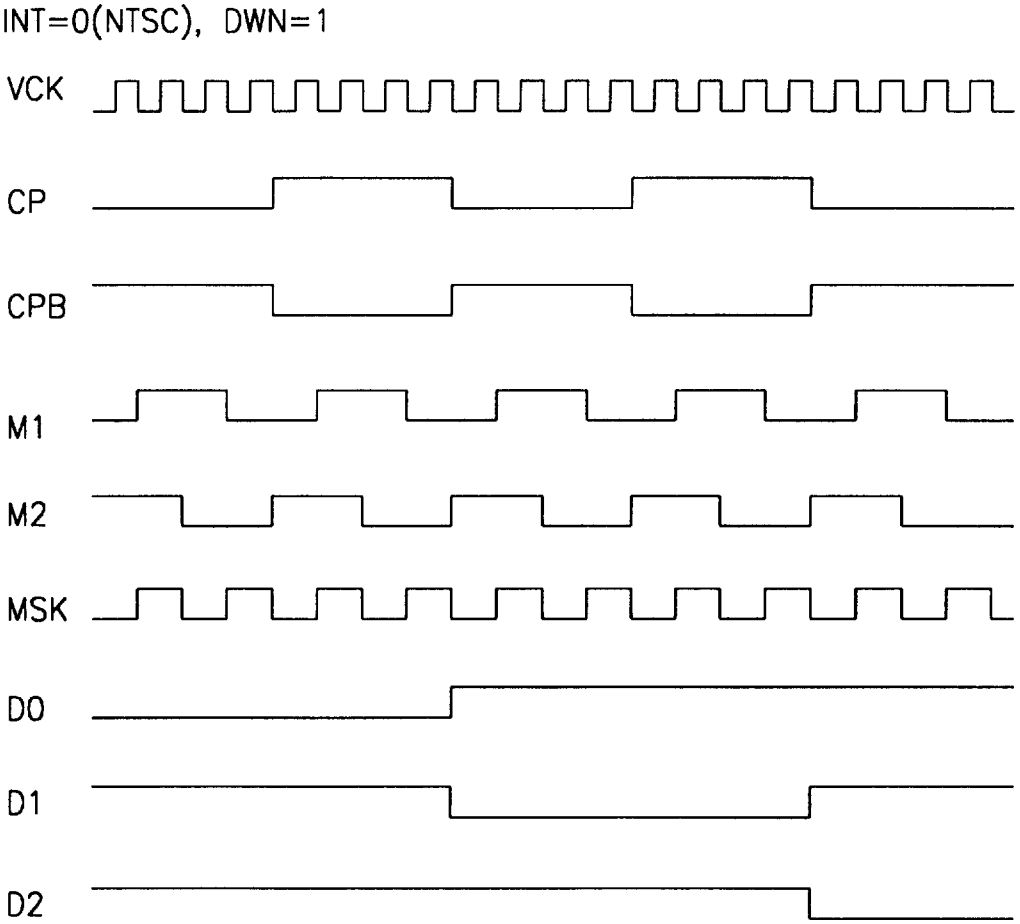

By contrast, in the case of the VGA signal, the high-level clock signals CP, CPB are applied to the T-flip-flop 104*a* during 4 cycles of system clock signal VCK, as shown in FIGS. 15(B) and 15(C).

In the case where the scanning direction control signal DWN is "1", that is, when gate lines GL1–GL479 are scanned from above to below, the multiplexer 104 selects the count signals A0–A5, and outputs them to the decoder 107, while in the case where the scanning direction control signal DWN is "0", that is, when gate lines GL1–GL479 are scanned from below to above, the multiplexer 105 selects the count signals B0–B5, and outputs them to the decoder 107.

The decoder 107, being operated as negative type 6×60 decoder, decodes the count signals outputted from the ripple counter 104, and sequentially outputs low-level decoding signals D0–D59 to the NOR gate array, as shown in FIGS. 14(D)–(H) or 15(G)–15(I). In the case where count signals B0–B5 are inputted, the decoder 107 decodes the inputted count signals B0–B5 and sequentially outputs low-level decoding signals D59–D0 to the NOR gate array 108, as shown in FIGS. 14(D) to 14(H) or 15(G)–15(I).

In the case of an NTSC signal, that is, in the case where the image mode signal INT is "1", the masking logic 106 outputs low-level pulse masking signal MSK which is a ground signal, to the NOR gate array 107. Accordingly, the NOR gate array 107 operates an an inverter.

On the other hand, in the case of a VGA signal, that is, in the case where the image mode signal INT is "0", the masking logic 106 outputs high-level pulse masking signal MSK to the NOR gate array 108 during 1 cycle of system clock signal VCK, as shown in FIG. 15(F).

With reference to FIG. 13, the NOR gate array 108 NORs the pulse masking signal MSK applied from the masking logic 106 and the decoding signals D0–D59, D59–D0 applied from the decoder 107, and applies the enable signals EN0–EN59 to the output cell array 109.

Figures 17A, 17B, 17C, 17D, 17E, 17F, 17G, 17H, 17I:
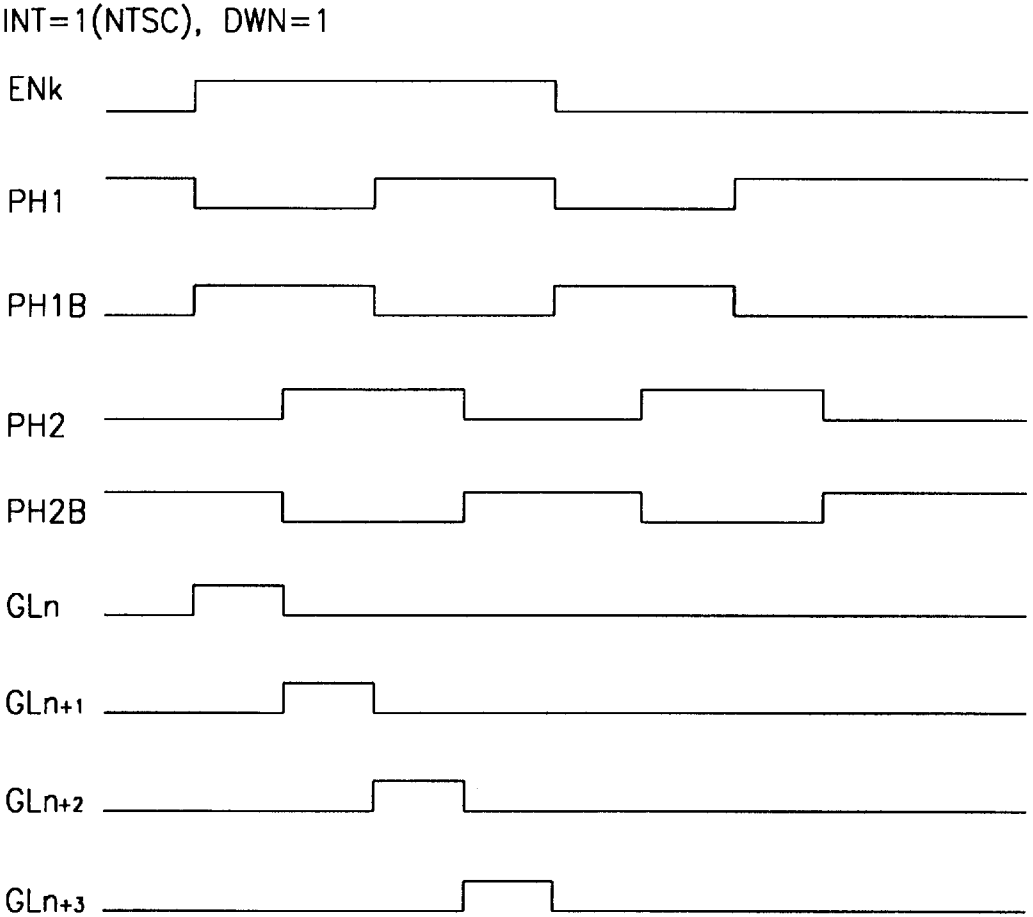

With reference to FIGS. 16 and 17, in the case of an NTSC signal, a random output cell included in the output cell array 109 receives the input high-level enable signal ENK during 4 cycles of system clock signal VCK. The random output cell simulataneously receives the input of the scanning pattern signals PH1, PH1B, PH2, PH2B, 1 cycle of which corresponds to 4 cycles system of clock signal VCK.

The inverters included in the buffer 108*e* and connected sequentially with each of NAND gates 109*a*–109*d*, play the role of a buffer to drive the large capacity loaded gate lines GLn–Gln+3, and each NAND gate 109*a*–109*d* with the three inverters connected sequentially there to 109*a*–109*d* operates substantially as an AND gate.

Subsequently, if the inputted enable signals ENK are low-level, the low-level scanning signals are applied to gate lines GLn–GLn+3 regardless of the remaining input signals, while if high-level, the high-or low level scanning signals are applied to gate lines GLn–GLn+3, depending on the inputted scanning pattern signals PH1, PH1B, PH2, PH2B.

Therefore, the output cell sequentially applies high-level scanning signals to the gate lines GLn–GLn+3, during 1 cycle of system clock signal VCK.

Figure 1:
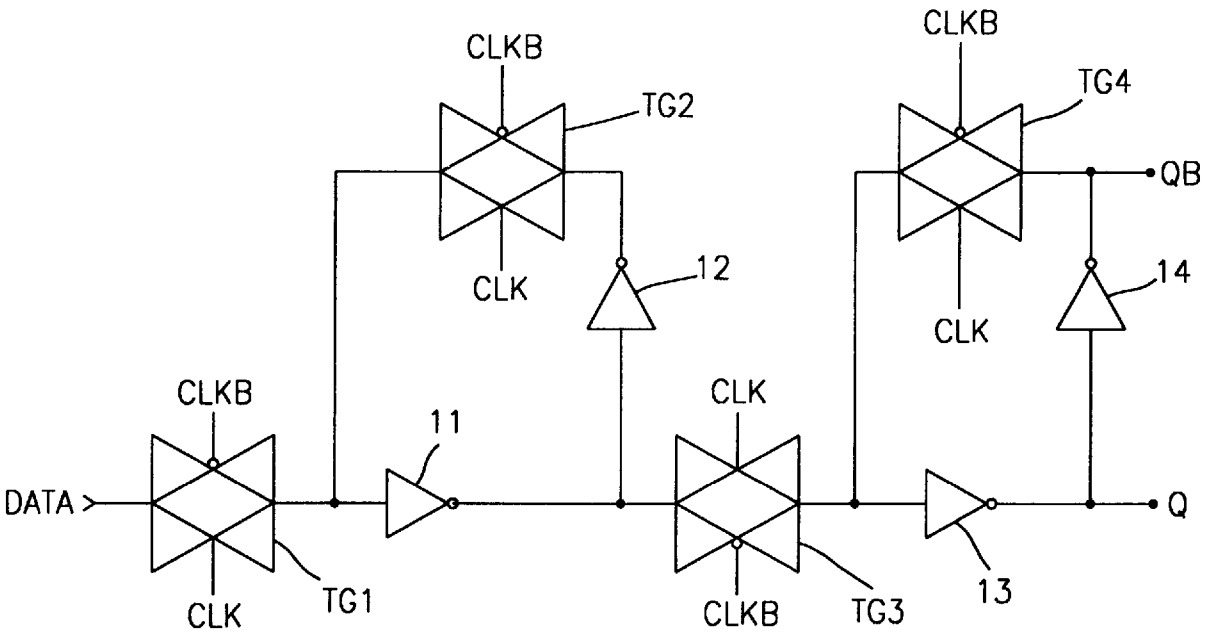
FIG. 1 CONVENTIONAL ART
FIG. 1 is a schematic circuit diagram of D flip-flops constituting a shift register used in a conventional gate driver circuit.
Figure 2:
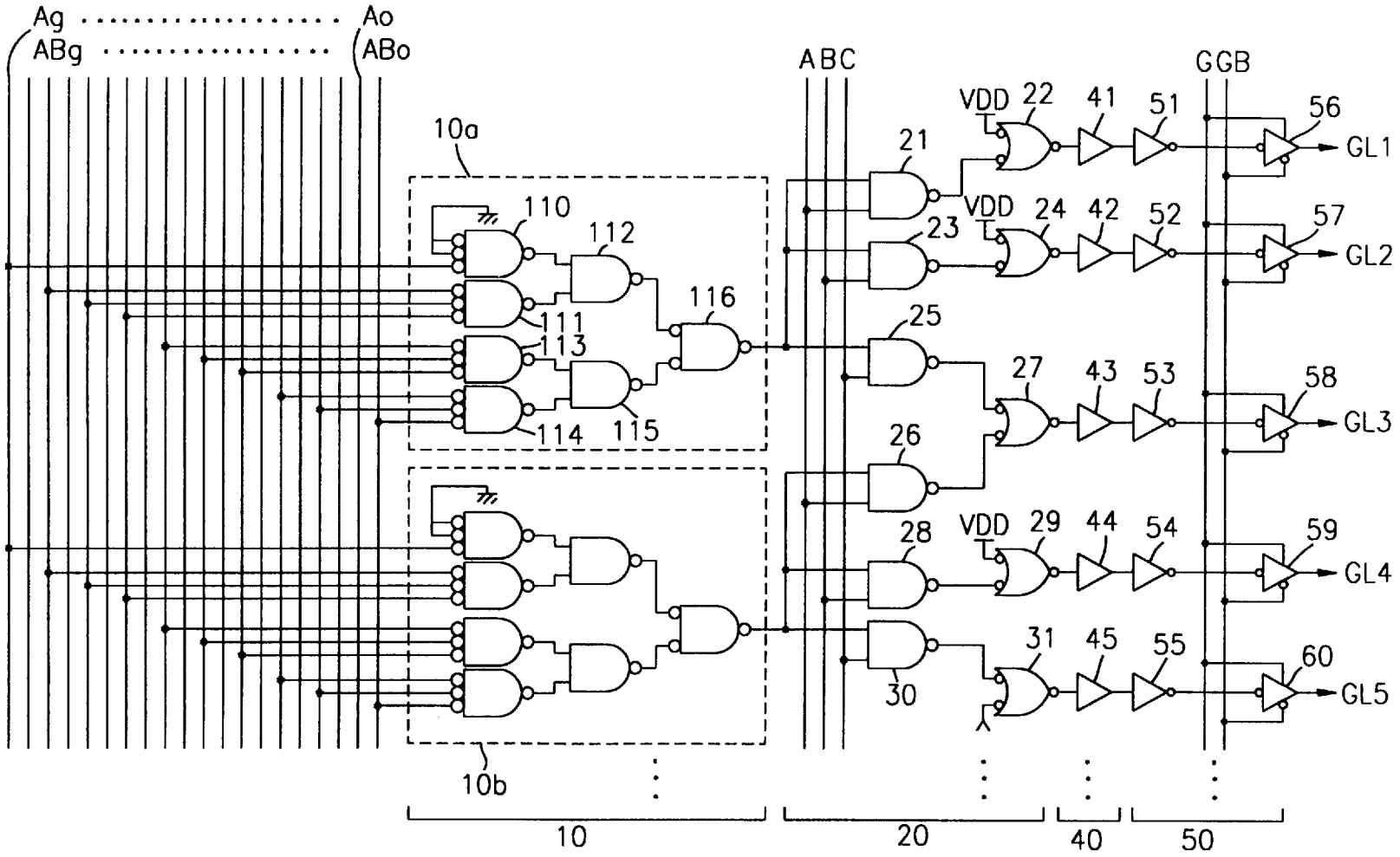
FIG. 2 CONVENTIONAL ART
FIG. 2 is a partial schematic circuit diagram of a gate driver circuit using a conventional decoder.
Figures 3A, 3B, 3C, 3D, 3E, 4A, 4B, 4C, 4D, 4E, 4F:
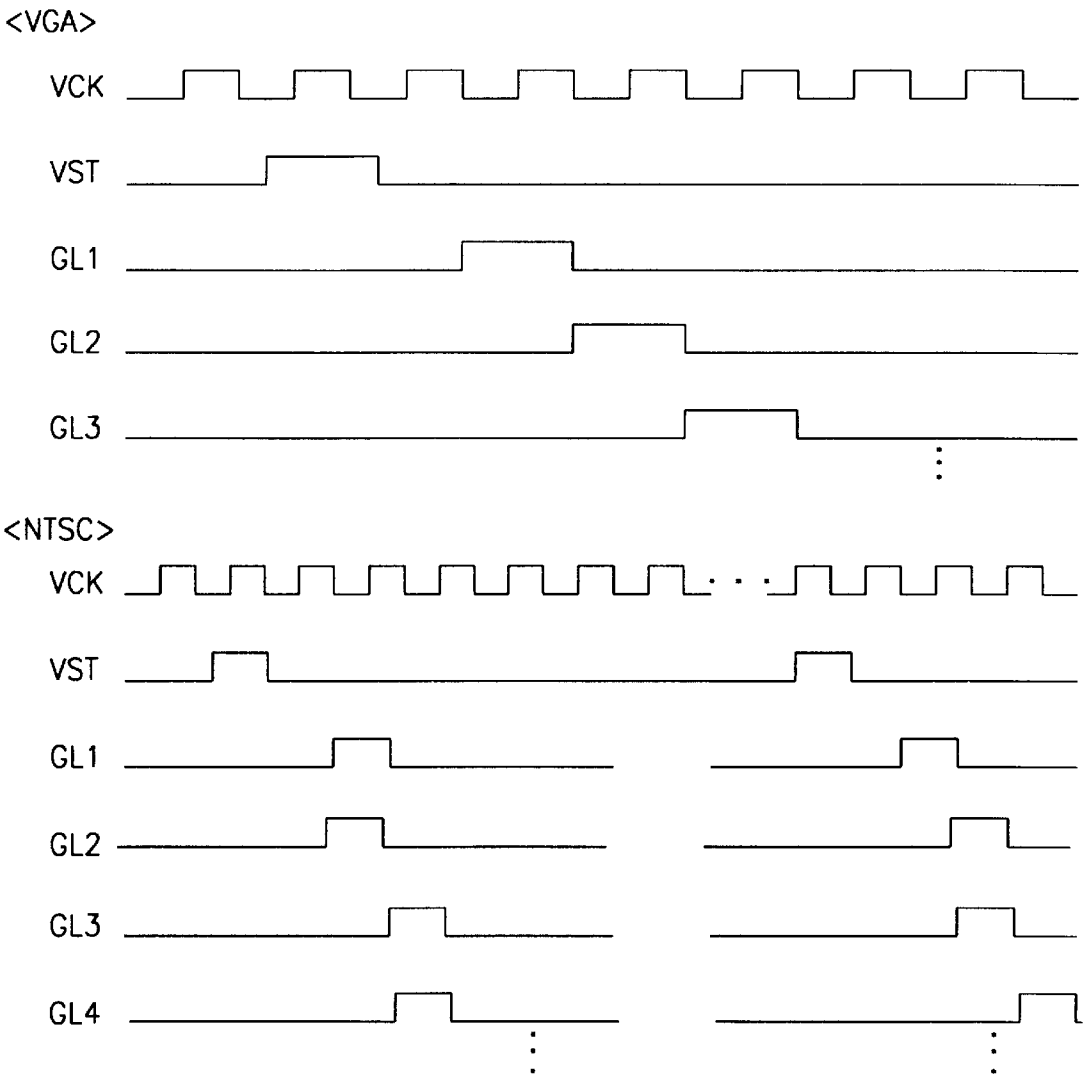
FIG. 3A CONVENTIONAL ART
FIG. 3B CONVENTIONAL ART
FIG. 3C CONVENTIONAL ART
FIG. 3D CONVENTIONAL ART
FIG. 3E CONVENTIONAL ART
FIG. 4A CONVENTIONAL ART
FIG. 4B CONVENTIONAL ART
FIG. 4C CONVENTIONAL ART
FIG. 4D CONVENTIONAL ART
FIG. 4E CONVENTIONAL ART
FIG. 4F CONVENTIONAL ART

In the case where the odd and even line drive units 100 and 200 are operated simultaneously, the scanning signals of the double scanning scheme for an NTSC signal are generated as the even field in FIG. 4, and in the case where the odd line drive unit 100 is operated earlier by 1 cycle of system clock signal VCK than the even line drive unit 200, the scanning signals for the NTSC signal are generated as the odd field in FIG. 4.

Figures 18A, 18B, 18C, 18D, 18E, 18F, 18G, 18H, 18I:
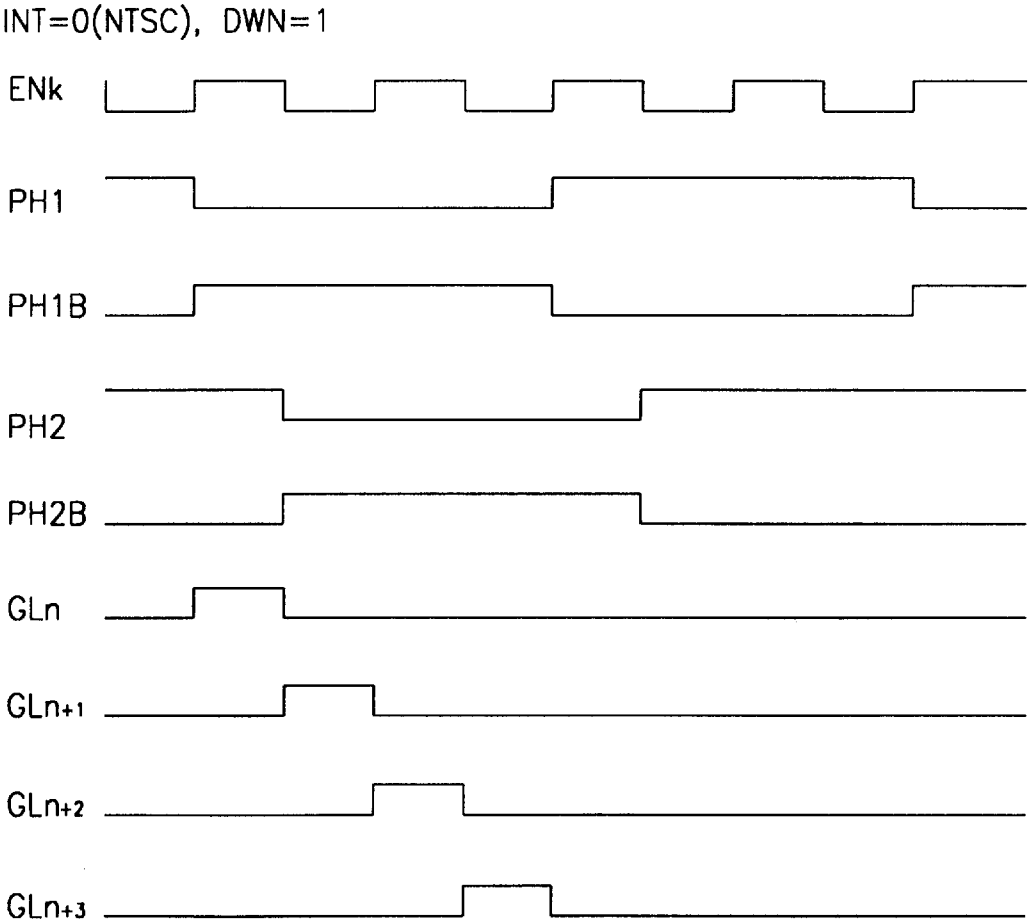

With reference to FIGS. 16 and 18, in the case of a VGA signal, a random output cell included in the output cell array 109 receives the input enable signal ENK which is a 4 cycle clock signal corresponding to 8 cycles of system clock signal VCK. As shown in FIG. 9, the random output cell receives at the same time the scanning pattern signals PH1, PH1B, PH2, PH2B, 1 of which corresponds to 8 cycles of the system clock signal VCK.

The output cell processes the input signals in the same way as for the NTSC signal, at the NAND gates 109*a*–109*d* and the buffer 109*e*, and sequentially applies high-level scanning signal VCK, but the scanning signals are generated for one clock cycle for 2 cycles of system clock signal VCK.

In the case where the odd line drive unit 100 is operated earlier by 1 cycle of system clock signal VCK than the even line drive unit 200, the odd and even line drive unites (100, 200) alternately generate the scanning signals, so that the scanning signals for such VGA signal as shown in FIG. 3 are obtained.

Figures 19A, 19B, 19C, 19D, 19E, 19F, 19G, 19H, 19I:
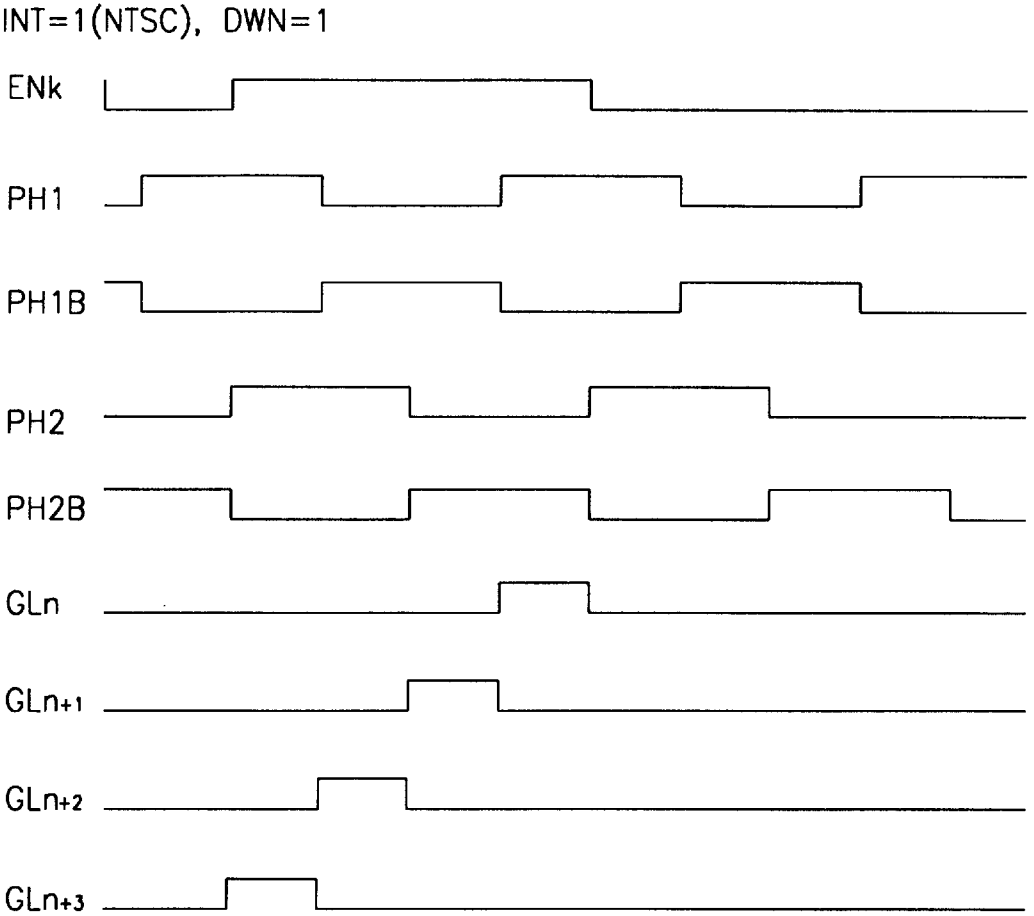

With reference to FIGS. 16 and 19, in the case of the NTSC signal, if the scanning direction control signal DWN is "0", the scanning signals are sequentially applied to gate lines GLn–GL+3 in accordance with the above-described procedure. Similarly, if the scanning direction control signal DWN is "0", even for the VGA signal, the scanning signals are sequentially applied to gate lines GLn+3–GLn.

Any data driver circuit capable of supplying image signals to the TFT-LCD panel may be embodied as the odd line drive unit 100 according to the present invention.

As described above, in the present invention address signals for designating the gate lines to be driven are not used, but instead a one bit image mode signal for determining whether the input image signals are NTSC or VGA signal is used. Therefore, the control unit to control the gate driver circuit can be embodied more simply than the conventional one, the number of input pins in the TFT-LCD pixel array can be reduced, and the size of the TFT-LCD pixel array can thereby be reduced. Moreover, the scanning signals can be generated bidirectionally, that is, from above to below, and vice versa, depending on the one bit selection signal.

What is claimed, is:

1. A driver circuit for a sequential and double scanning of a thin film transistor liquid crystal display (TFT-LCD), comprising;

scanning pattern generator means for receiving a scanning direction signal, a display image mode signal and a first clock signal and for generating a complementary pair of second clock signals, first and second masking signals and a plurality of scanning pattern signals in accordance therewith;

ripple counter means for counting the second clock signals generated by the scanning pattern generator means and outputting a plurality of count signals;

multiplexer means for selecting from among the plurality of count signals outputted by the ripple counter means those count signals corresponding to a scanning direction in accordance with the scanning direction signal;

decoder means for decoding the count signals selected by the multiplexer means and outputting plural decoding signals in conformity with the scanning direction;

masking logic means for outputting a masking pulse signal in accordance with the masking signals from the scanning pattern generator means and the display image mode signal;

NOR gate array means including a plurality of NOR gates for each NORing the masking pulse signal from the masking logic means with a respective one of the plurality of decoding signals outputted by the decoder means and outputting a plurality of enable signals in accordance therewith; and output cell array means including a plurality of output cells for logically operating the plurality of enable signals outputted from the NOR gate array means with the plurality of scanning pattern signals generated by the scanning pattern generator means and applying the resultant logically operated signals as scanning signals to respective gate lines of the TFT-LCD.

2. The driver circuit according to claim 1, further comprising;

second multiplexer means for selectively outputting one of a first one and a last of the scanning signals from the output cell array as a final scanning signal in accordance with the scanning direction signal, for resetting the scanning pattern generator means and the ripple counter means.

3. The driver circuit of claim 2, wherein, in a first state of the scanning direction signal corresponding to a top-to-bottom scanning of the gate lines of the TFT-LCD, the second multiplexer means outputs the last scanning signal as the final scanning signal, and, in a second state of the scanning direction signal corresponding to a bottom-to-top scanning of the gate lines of the TFT-LCD, the second multiplexer means outputs the first scanning signal as the final scanning signal.

4. The driver circuit of claim 1, further comprising;

input control unit means for receiving a scanning start signal, a system clock signal, a system reset signal and a final scanning signal applied to a lastly-scanned gate line of the TEF-LCD and generating the first clock signal and a reset signal for the scanning pattern generator means and the ripple counter means in response thereto.

5. The driver circuit of claim 4, wherein the input control unit means comprises:

an OR gate for ORing the scanning start signal with the final scanning signal;

a T-flip/flop receiving at a clock input terminal thereof an output signal from the OR gate and receiving at a reset input terminal thereof the system reset signal;

an AND gate for ANDing the system clock signal with a noninverted output signal of the T-flip/flop for generating thereby the first clock signal; and an exclusive-OR gate for exclusive-ORing the final scanning signal with the system reset signal for generating thereby the reset signal.

6. The driver circuit of claim 1, wherein the scanning pattern signal generator means comprises;

a first T-flip/flop receiving at a clock input input terminal thereof the first clock signal and receiving at a reset input terminal thereof the reset signal;

a second T-flip/flop receiving at a clock input input terminal thereof a noninverted output signal of the first T-flip/flop and receiving at a reset input terminal thereof the reset signal, and outputting at an inverting output terminal the first masking signal;

a third flip/flop receiving at a clock input terminal thereof an inverted output signal of the first T-flip/flop and receiving at a reset terminal thereof the reset signal, and outputting at a noninverting output terminal thereof the second masking signal;

a fourth T-flip/flop receiving at a clock input terminal thereof an inverted output signal of the third T-flip/flop and receiving at a reset input terminal thereof the reset signal;

a fifth T-flip/flop receiving at a clock input input terminal thereof the noninverted output signal of the third T-flip/flop and receiving at a reset input terminal thereof the reset signal;

a first multiplexer receiving at first input terminals thereof respective output signals of noninverting and inverting output terminals of the second and third T-flip/flops, receiving at second input terminals thereof respective output signals of noninverting and inverting output terminals of the fourth and fifth T-flip/flops, and selecting between and outputting as the second clock signals the signals received at the first or second input terminals thereof in response to the display image mode signal; and a second multiplexer receiving at first input terminals thereof respective output signals of the first multiplexer in a first order, receiving at second input terminals thereof the respective output signals of the first multiplexer in a second order opposite to the first order, and selecting between and outputting as the scanning pattern signals the signals received at the first or second input terminals thereof in response to the scanning direction signal.

7. The driver circuit of claim 6, wherein the first and second masking signals have an active high logic level during two clock cycles of the first clock signal.

8. The driver circuit of claim 6, wherein, when a state of the display image mode signal corresponds to an NTSC image mode, the first multiplexer selects and outputs as the second clock signals the signals received at its first input terminals from the third T-flip-flop, and, when the state of the display image mode signal corresponds to a VGA image mode, the first multiplexer selects and outputs as the second clock signals the signals received at its second input terminals from the fourth T-flip/flop, respectively.

9. The driver circuit of claim 1, wherein the masking logic means comprises;

an exclusive-NOR gate for exclusive-NORing the first and second masking signals generated by the scanning pattern generator means; and a multiplexer for selecting between one output signal of the exclusive-NOR gate and a low level ground voltage signal in accordance with the display image mode signal, and outputting the selected signal as the masking pulse signal.

10. The driver circuit of claim 9, wherein, when a state of the display image mode signal corresponds to an NTSC image mode, the multiplexer selects and outputs the output signal of the exclusive-NOR gate as the masking pulse signal, and, when the state of the display image mode signal corresponds to a VGA image mode, the multiplexer selects and outputs the low level ground voltage signal as the masking pulse signal.

11. The driver circuit of claim 1, wherein the multiplexer means selects and outputs one group from among first and second groups of the plurality of count signals outputted by the ripple counter, in accordance with the scanning direction signal, and wherein the decoder means generates the decoding signals corresponding to the groups of count signals outputted by the multiplexer means.

12. The driver circuit of claim 1, wherein each output cell of the output cell array means comprises:

a plurality of NAND gates for each NANDing one of the plurality of enable signals outputted from the NOR gate array means and a respective one of the plurality of scanning pattern signals generated by the scanning pattern generator means; and an output buffer for buffering an output signal of each NAND gate and applying the buffered output signal to a gate line of the TFT-LCD.

13. The driver circuit of claim 1, wherein, when a state of the display image mode signal corresponds to an NTSC image mode, the second clock signals have a high level pulse width of two cycles of the first clock signal, and, when the state of the display image mode signal corresponds to a VGA image mode, the second clock signal have a high level pulse width of four cycles of the first clock signal.

14. The driver circuit of claim 1, wherein, when a state of the display image mode signal corresponds to an NTSC image mode, one cycle of the scanning pattern signals corresponds to four cycles of the first clock signal, and, when the state of the display image mode signal corresponds to a VGA image mode, one cycle of the scanning pattern signals corresponds to eight cycles of the first clock signal.

* * * * *